US006138389A

United States Patent [19]

Kanazawa et al.

[11] Patent Number: 6,138,389

[45] Date of Patent: Oct. 31, 2000

[54] IRON BOTTOM SURFACE WITH PLATED METAL FILM

[75] Inventors: Narutoshi Kanazawa, Sakai; Toshimitsu Kurumizawa, Mino; Masao Shimizu, Nishinomiya; Toshihide Nakamura; Shinichiro Kobayashi, both of Osaka; Toru Taniguchi, Daitou; Toshiyuki Maeda, Toyoho-gun; Hiroaki Matsuyoshi, Higashioska; Mitsuaki Yamada, Ibaraki; Michio Saito, Senboku-gun, all of Japan

[73] Assignees: Matsushita Electric Industrial Co., Ltd.; Osaka Gas Company Limited, both of Osaka, Japan

[21] Appl. No.: 08/718,940

[22] Filed: Sep. 24, 1996

[30] Foreign Application Priority Data

| | | | |
|---|---|---|---|
| Sep. 25, 1995 | [JP] | Japan | 7-245737 |
| Jan. 24, 1996 | [JP] | Japan | 8-009768 |
| Jun. 25, 1996 | [JP] | Japan | 8-164070 |
| Jun. 25, 1996 | [JP] | Japan | 8-164071 |

[51] Int. Cl.[7] ..... D06F 75/38

[52] U.S. Cl. ..... 38/93

[58] Field of Search ..... 38/93, 74, 80, 38/81; 428/421, 422; 427/384, 385.5, 388.1, 388.2, 409

[56] References Cited

U.S. PATENT DOCUMENTS

| | | | |
|---|---|---|---|
| 3,142,916 | 8/1964 | Jacobson | 38/93 X |
| 3,480,461 | 11/1969 | Lynge | 38/93 X |
| 3,930,325 | 1/1976 | Schaeffer et al. . | |
| 4,642,922 | 2/1987 | Prudenziati . | |
| 4,800,661 | 1/1989 | Yamamoto et al. | 38/93 |
| 4,862,609 | 9/1989 | Ullrich et al. | 38/93 |
| 5,165,185 | 11/1992 | Gardaz et al. | 38/93 |

FOREIGN PATENT DOCUMENTS

| | | | |
|---|---|---|---|
| 48-64290 | 9/1973 | Japan . | |
| 54-93588 | 7/1979 | Japan . | |
| 55-33143 | 3/1980 | Japan . | |
| 57-63598 | 4/1982 | Japan . | |
| 57-117900 | 7/1982 | Japan . | |
| 150799 | 8/1985 | Japan | 38/93 |
| 3071300 | 9/1986 | Japan | 38/93 |

*Primary Examiner*—Ismael Izaguirre
*Attorney, Agent, or Firm*—Wenderoth, Lind & Ponack, L.L.P.

[57] ABSTRACT

An iron comprising a bottom member as an ironing face, which is provided with a plated metal film containing fluorine compound fine particles, so that the ironing face provides high surface hardness which shows less wear, good slidability and less generation of static electricity.

20 Claims, 5 Drawing Sheets

IRON BOTTOM SURFACE WITH PLATED METAL FILM

BACKGROUND OF THE INVENTION

1. Field of the Invention

The present invention relates to an iron for general home use or for business use.

2. Prior Art

The irons which have hitherto been in use comprise an iron base whose surface is coated with fluorine so as to prevent adhesion of starch to the clothes during the ironing work, or to endure the high temperature ironing work, or to permit smooth ironing work.

THE SUMMARY OF THE INVENTION

Recently, with the aim of improving the operative convenience, cordless irons have come to be used progressively. In consequence of this trend, heavy weight iron bases are used to improve heat storage property. Nevertheless, the surface treatment conditions of the iron base have been as heretofore. Therefore, the sliding property which is especially important in realizing smooth ironing work has been deteriorated. Further, in connection with this property, there has arisen a problem in ironing such that the clothes to be ironed tend to cling to the iron base due to the static electricity generated between the iron and the clothes. Furthermore, there have been the problems of the surface fluorine coating layers to be damaged by the buttons and fasteners on the clothes.

The present invention is to settle the problematic points held by the conventional constitution, and its objects are to provide an iron which shows good slidability which is important in smooth ironing work, and which is less apt to be damaged by buttons or fasteners on the clothes or shows less wear, and less generation of static electricity.

By plating a composite plating film on the surface of the base member, there is obtained an iron having high surface hardness, showing less wear, good slidability and less generation of static electricity.

In the present invention, the particle size of the fluorine compound fine particles to be added to the plating liquid for forming a composite plating film (hereinafter to be referred to as composite plating liquid) is not particularly limited. However, when the particle size is larger than the film thickness of the whole composite plating film, the particles come off from the plating surface by abrasion. Therefore, it is desirable to use the fine particles having a size smaller than the thickness of the plating film.

The thickness of the composite plating film is normally 5 to 30 $\mu$m, more preferably about 8 to 20 $\mu$m. When the thickness of the plating film is smaller than 5 $\mu$m, problem occurs in durability. When the plating film thickness is larger than 30 $\mu$m, tight contact property of the plating film to the base member becomes poor, and the cost becomes high.

Accordingly, the particle size of the fluorine compound fine particles may be determined in consideration of the thickness of the composite plating film. The particle size is normally about 2 $\mu$m, and the one of not more than 1 $\mu$m on the average is more preferable. It is desirable for the composite plating film not to contain rough particles of the size larger than 30 $\mu$m, so as to preserve uniformity of dispersion of the fluorine compound fine particles in the composite plating liquid and composite plating film. The amount of the fluorine compound fine particles to be added to the composite plating liquid is not specifically limited, but usually it is no more than about 200 g/L, preferably about 1 to 100 g/L.

In the present invention, the kind of the plating liquid to be added to the fluorine compound fine particles is not specifically limited. Ordinary electroplating liquid which can precipitate a metal at the cathode by an electroplating process or a non-electrolytic plating liquid which causes reduction precipitation by electrons supplied from the reducing agents such as phosphinate or boron-hydrogen compound by non-electrolytic plating method may be used. Examples of the plating liquids are those of copper, nickel, chromium, zinc, cadmium, tin, iron, lead, precious metals and their alloys. These plating liquids of various compositions are known, and any of these known plating liquids may be usable in the present invention.

In the plating liquid of the present invention, a surfactant is used to have the fluorine compound fine particles evenly dispersed in the plating liquid. As a surfactant, it is necessary to use the surfactant molecules which show cationic property in pH in the plating liquid. There may be used, for example, water-soluble cationic, nonionic or amphoteric surfactant which shows cationic property in the pH of the plating liquid. In this case, as the cationic surfactants, there may be a quaternary ammonium salt, secondary and tertiary amines, imidazolines, and the like. Examples of the nonionic surfactants are polyoxyethylene, polyethylene imine, ester, etc. Especially, it is desirable to use a fluorine based surfactant having C—F bond in the molecule. The nonionic surfactant having C—F bond in the molecule shows cationic property only in the case of the acidic plating liquid.

The amount of addition of the surfactant to the plating liquid is preferably 1 mg to 100 mg based on 1 g of the fluorine compound fine particles, and more preferably about 1 mg to 50 mg based on 1 g of the fluorine compound fine particles.

In the plating liquid of the present invention, in order to have the fluorine compound fine particles uniformly dispersed, plating is desirably carried out while stirring the plating liquid. The stirring method is not specifically limited, and ordinary mechanical stirring means, e.g. screw stirring, stirring with magnetic stirrer, may be adopted.

The plating conditions may be optionally determined according to the kind of the plating liquid to be used. In general, the liquid temperature, pH, and current density may be the same as those of the ordinary plating.

In the plating film to be formed by the plating liquid of the present invention, the amount of the fluorine compound fine particles to be contained in the plating film may be optionally determined according to the object of use. The co-precipitation amount of the fluorine compound fine particles can be optionally changed according to the adjustment of the addition amount of the fluorinated compound fine particles in the plating liquid, adjustment of the plating conditions, etc.

The second means of the present invention is characterized in specially adopting more than 15% by volume of the content of the fluorine compound fine particles to increase the amount of the fluorine compound fine particles distributed over the surface of the plating layer, so as to provide an iron with elevated non-tackiness property with which the starch of the clothes to be ironed can be prevented from adhering to the iron. Here, it is desirable for the upper limit of the content of the fluorine compound fine particles to be 50% by volume. This is because, when the content of the fluorine compound fine particles exceeds 50% by volume, there is a tendency to cause appearance defects of stain, unevenness, etc. on the plating layer in composite plating processing.

The third means of the present invention is to provide a composite plating film on the surface of the iron base member, followed by subjecting it to heat treatment at a temperature higher than the melting point of the fluorine compound fine particles (excluding graphite fluoride) to improve the durability of the composite plating film.

The heat treatment time is not specifically limited. Normally, the heat treatment may be carried out for about 10 to 30 minutes. When the heat treatment temperature is higher than the melting point of the fluorine compound fine particles by more than 50° C., the plated film has a likelihood to show deterioration.

The fourth means of the present invention is specially to make the surface roughness of the composite plating provided on the iron bottom base member no more than 1.0 $\mu$m to provide an iron having good slidability.

The fifth means of the present invention is to solve the point of the conventional aluminum die cast material which is less easy to be plated and is apt to show loss of corrosion resistance due to the surface pores. This problem has been settled by using an aluminum rolled plate for the iron bottom base member.

The sixth means of the present invention is in being furnished with a base member which is to be heated by the heater and an ironing face member by combining on the bottom surface side of the base member by forming a composite plating film containing the fluorine compound fine particles in dispersed state, by which it is possible to prevent formation of the composite plating film on the base member and to prevent undesirable effect on the heater which is provided on the base member, and further, to make it possible to carry out ironing by the ironing face member combined with the lower surface side of the base member. Moreover, by the composite plating film containing the fluorine compound fine particles in dispersed state, the hardness of the ironing face can be increased to prevent scratches, and the abrasion resistance is improved to give less wear on the long-period ironing. Furthermore, because the composite plating film contains the fluorine compound fine particles in dispersed state, when the temperature of the ironing face in use is high, sliding property between the iron and the clothing is improved to allow ironing with ease.

The seventh means of the present invention is to form an evaporation chamber on the base member. As it is possible to prevent formation of the composite plating film containing the fluorine compound fine particles in dispersed state on the surface of the evaporation chamber, the water which dropped into the evaporation chamber can be favorably evaporated to generate steam.

The eighth means of the present invention is that an ironing face member is provided on a part of the lower surface side. By reducing the area for forming the composite plating film, realization at a low price is possible.

The ninth means of the present invention is to provide steam holes on the ironing face member and to provide a pathway for leading the steam generated in the evaporation chamber to the steam holes between the base member and the ironing face member, by which it is possible to form the distance from the evaporation chamber to the steam holes long, and to take out the evaporation residues and impurities such as water scum accumulated on the pathway of the base member on the lower surface side and eliminate.

The tenth means of the present invention is that the ironing face member is taken out from the upper surface side of the base member, which serves to smooth the ironing face, and to prevent the screws for fixing the ironing face member to the base member from catching the clothing.

The eleventh means of the present invention is to have arranged a good heat conductive member between the base member and the ironing face member, by which it is possible to transfer the heat from the base member to the ironing face member in good efficiency, and to make the surface temperature of the ironing face member evenly elevated.

The twelfth means of the present invention is to constitute the ironing face member by forming a composite plating film containing the fluorine compound fine particles on the surface of the aluminum rolled plate. It is possible to form a rigid coating film free from the danger of release of the composite plating film from the aluminum rolled plate by the air swollen by heating

DETAILED DESCRIPTION OF THE INVENTION

Figure 1:
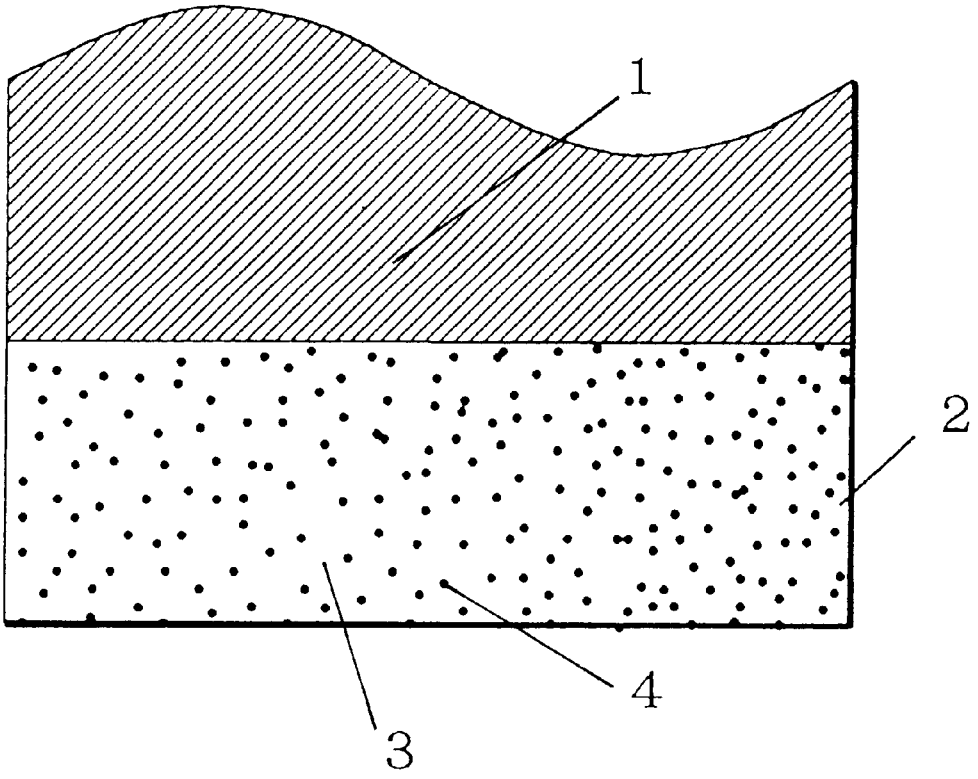
FIG. 1 is a sectional view to show the constitution of the iron according to an embodiment of the present invention.

The preferred embodiments of the present invention will be explained hereinbelow. FIG. 1 is a sectional view of an iron showing the present embodiment. The surface of the bottom base member 1 of the iron is provided with a plating layer 2. The bottom base member 1 is made of aluminum in the present embodiment. The plating layer 2 has a constitution comprising the fluorine compound fine particles 4 uniformly dispersed in nickel, chromium or transition metal 3 of a combination of them.

In the case of plating a plating layer 2 on the bottom base member 1 as the above constitution, a surfactant is used at the same time. The surfactant is distributed around the fluorine compound fine particles 4, and plating is applied to the base member 1 simultaneously with the transition metal 3 by the electric charge held by the surfactant. Accordingly, the plating layer 2 becomes a matrix constitution of the fluorine compound fine particles 4 evenly distributed in the transition metal 3. Accordingly, in comparison with the conventional constitution in which the surface treatment of the base member is made only with the fluorine resin, the hardness is greatly increased. Further, as described above, as the plating layer 2 has the fluorine compound fine particles 4 in uniform state, slidability to the clothing is satisfactory. Moreover, by the presence of the transition metal 3, there is provided an iron which shows less generation of static electricity during the ironing work.

Also, in this case, when the content of the fluorine compound fine particles 4 is more than 15% by weight, non-tackiness free from adhesion of starch of the clothes can be secured in ironing, and at the same time slidability can be secured. In other words, even in case of excess of 15% by volume, non-tackiness property makes no difference, but in case of the amount being 10% by volume or less, definite difference occurs.

Further, by using the smooth bottom base member 1, the surface unevenness of the plating layer 2 formed on the surface is reduced to make it possible to improve the sliding property further, or only the surface of the plating layer 2 may be smoothed. Namely, in the case where the finishing extent of the plating layer 2 of the bottom base member 1 is set to be no more than 1.0 $\mu$m when measured by the center line surface roughness, the sliding property can be further improved.

The pitch fluoride to be used in the present invention is disclosed, for example, in Japanese Patent Laid-Open Publication No. 275190/1987, and is obtainable by fluorinating the pitch with a fluorine gas.

The pitch to be used as a material for producing the pitch fluoride normally has a layer structure with lamination of the aromatic group condensation 6-member ring plane, and the aromatic group which constitutes the 6-member ring plane has a crosslinked structure by the aliphatic hydrocarbon group such as methylene. As the material for production of the pitch fluoride, there may be exemplified a pitch made by eliminating the low boiling point components having the boiling temperature of less than 200° C. by distilling the petroleum or coal based heavy oil such as petroleum distillation residue, naphtha thermal decomposition residue, ethylene bottom oil, coal liquefied oil, or coal tar, and further the pitch which is subjected to heat treatment and/or hydrogenation treatment. More concretely, the pitch to be used as a material for producing the pitch fluoride includes, for example, isotonic pitch, mesophase pitch, hydrogenated mesophase pitch, meso-carbon microbeads comprising the mesophase globe formed after eliminating the low boiling point components by distilling petroleum or coal based heavy oil.

The pitch fluoride is obtainable, for example, by reacting the above material pitch with fluorine at about 0° to 350° C. As the method for producing the pitch fluoride, more concretely, the following methods can be exemplified.

(1) Method of directly reacting a material pitch with fluorine gas at a temperature of about 0° to 350° C.

The preferable temperature in reacting the pitch with fluorine gas is no more than the softening point of the pitch. Though the fluorine gas pressure in reaction is not specifically limited, generally the pressure is in the range of 0.07–1.5 atoms. In this reaction, the fluorine gas may be used as such, or by diluting with inert gas such as nitrogen, helium, argon, neon, etc.

The resulting pitch fluoride comprises substantially carbon atoms and fluorine atoms. The F/C atomic ratio is, for example, about 0.5–1.8. Such pitch fluoride shows the characteristics of the following (a), (b), (c) and (d).

(a) In the powder X-ray diffraction, the largest strength peak is shown in the neighborhood of $2\theta=13°$, and a peak smaller in strength than the foregoing peak is shown in the neighborhood of $2\theta=40°$.

(b) In the X-ray photoelectron spectrometry, there are shown a peak corresponding to CF group at 290.0+1.0 eV and a peak corresponding to $CF_2$ group in the neighborhood of 292.5+0.9 eV. The ratio of the peak strength of the peak corresponding to CF group to the peak corresponding to $CF_2$ group is about 0.15–1.5.

(c) It is possible to form a film by vacuum evaporation.

(d) The contact angle to water at 30° C. is 141°+8°.

The fluorinated pitch in (1) above is a white to yellow white or brown solid, very stabilized compound having excellent water resistance and chemical resistance.

Further, the pitch fluoride may be obtained in a transparent resin-like style.

Such transparent resin-like pitch fluoride is obtained, for example, by reacting the pitch fluoride for a predetermined time, for example, about 1–18 hours, preferably about 6–112 hours, in an atmosphere containing fluorine gas, under the condition of temperature elevation at the rate of 0.1°–3° C./min., preferably 0.5–1.5° C./min., to about 250°–400° C. The resulting transparent resin-like pitch fluoride shows, for example, the following characteristics:

F/C: 1.5–1.7

Light transmittance (250–900 nm): 90%

Molecular weight: 1500–2000

Softening point: 150°–250° C.

The colored pitch fluoride to be used in the present invention is, for example, described in Japanese Patent Application No. 278855/1995 specification and Japanese Patent Application No. 77698/1996 specification, and is obtainable by reacting a pitch fluoride with a dye or a pigment.

The dye or pigment to be used in the production of the colored pitch fluoride is not specifically limited, but, considering from the point of the reactivity with the pitch fluoride, one having a functional group is preferable, and use of basic dyestuff, dispersing dyestuff, etc. is recommended.

The solvent to be used in the coloring reaction of the pitch fluoride may be any of the fluorine solvent or organic solvent or a mixed solvent of them with water. In case of using a fluorine solvent, the solvent may be able to dissolve the material pitch fluoride to a moderate degree. Examples of such solvent are hexafluorobenzene, perfluorodecaline, perfluorodecahydrophananthrene, trifluorobenzene, 1,1,2-trichloro, 1,2,2-trifluoroethane, etc. In case of using an organic solvent, water-soluble solvent is preferable, whose examples are alcohols of methanol, ethanol, propanol, butanol, etc., ketones of acetone, ethylmethyl ketone, diethyl ketone, methylisopropyl ketone, etc., acetonitrile, THF, or the mixed solvent of them with water. In case of using an organic solvent as a solvent, since the pitch fluoride is insoluble in organic solvent, it is necessary to have dyestuff or pigment dispersed better with water or water-soluble solvent instead of the pitch fluoride. For this reason, the mixing ratio of the aforedescribed organic solvent with water is preferably 0 to 10 parts by weight, preferably 0.1 to 5 parts by weight, based on 1 part by weight of the water-soluble organic solvent. When the mixing proportion of water is lowered, the dispersion state of dyestuff or pigment in the reaction liquid is deteriorated. To the contrary, when the mixing proportion of water increases, there is a defect that, because the pitch fluoride is water-repellent matter, the dispersion state of the pitch fluoride in the reaction liquid is deteriorated. The amount of the solvent to be used in the reaction is suitably 1 to 100 parts by weight, preferably 5 to 30 parts by weight, based on 1 part by weight of the pitch fluoride.

The reaction temperature to be used in the present invention is not specifically limited, and may be from room temperature to the refluxing temperature of the solvent. However, since the reaction speed is retarded under a low temperature, the reaction is preferably carried out at a temperature near the refluxing temperature.

In order to separate the thus obtained crude colored pitch fluoride from the unreacted dyestuff or pigment and purify it, a method of extracting the unreacted dyestuff or pigment without dissolving and by using the aforedescribed fluorine solvent which is a solvent capable of dissolving the colored pitch fluoride, is effective. The amount of the fluorine solvent to be used is suitably 1 to 100 parts by weight, preferably 5 to 30 parts by weight, based on 1 part by weight of the colored pitch fluoride. The pitch fluoride obtained by extraction is purified as the desired compound by evaporating the used fluorine solvent.

In case the pitch fluoride is reacted with the dyestuff as a material by using a solvent, because the pitch fluoride is separated from the unreacted dyestuff and purified, a method of washing a crude colored pitch fluoride by using water which is a solvent capable of not dissolving the colored pitch fluoride but dissolving the unreacted dyestuff or the aforedescribed organic solvent or their mixed solvent with water is effective. The amount of the fluorine solvent to be used is suitably 1 to 100 parts by weight, preferably 5 to 30 parts by weight, based on 1 part by weight of the colored pitch fluoride. The pitch fluoride obtained by extraction is then purified as the desired compound by evaporating the used solvent.

EXAMPLES

The following examples and comparative examples will illustrate the characteristic features of the present invention more clearly.

Reference Example 1

To the coal tar pitch having a softening point at 100° C., 0.2% by weight of quinoline insoluble content, and 30% by weight of benzene insoluble content, twofold amount of anthracene hydride oil was added, and the mixture was heated at 430° C. for 90 minutes, followed by eliminating the anthracene oil under reduced pressure at 300° C. to give a reduced pitch.

Next, a nitrogen gas was introduced to the resulting reduced pitch to remove the low molecular weight component, the pitch was subjected to thermal polymerization at 450° C. for 5 hours to give a mesophase pitch having a softening point at 300° C., 60% by weight of quinoline insoluble content, 98% by weight of benzene insoluble content, and more than 90% by weight of mesophase content.

Fifty grams of the resulting mesophase pitch were pulverized and charged into a nickel reaction vessel. The system inside was evacuated and filled with argon gas, after which a mixed gas of 20% fluorine and 80% argon was passed at 70° C. at an average flow rate of 650 cc/min. to have reaction continued for 20 hours to give 144 g of fluorinated pitch particles. As a result of the elementary analysis, the composition formula was $CF_{1.38}$, and the average particle size thereof was 1.3 $\mu$m.

Measurement of Contact Angle

Using a FACE contact angle gauge (CA-A type, made by Kyowa Kaimen Kagaku Kabushiki Kaisha), the contact angle of water was measured by a droplet method.

Non-Tackiness Test

The clothes to which starch was actually adhered were ironed, and judgement was made to what extent the starch of the clothes adhered to the bottom base face of the iron.

Slidability Test

There was examined in what manner the slidability changed when the surface roughness of the composite plating film of the bottom base member 1 was changed. The experiment was evaluated by examining at what point the indication value of the tension gauge started to shift when the iron placed on a cotton test cloth was drawn by using a tension gauge.

Static Electricity Generation Test

Figure 2:
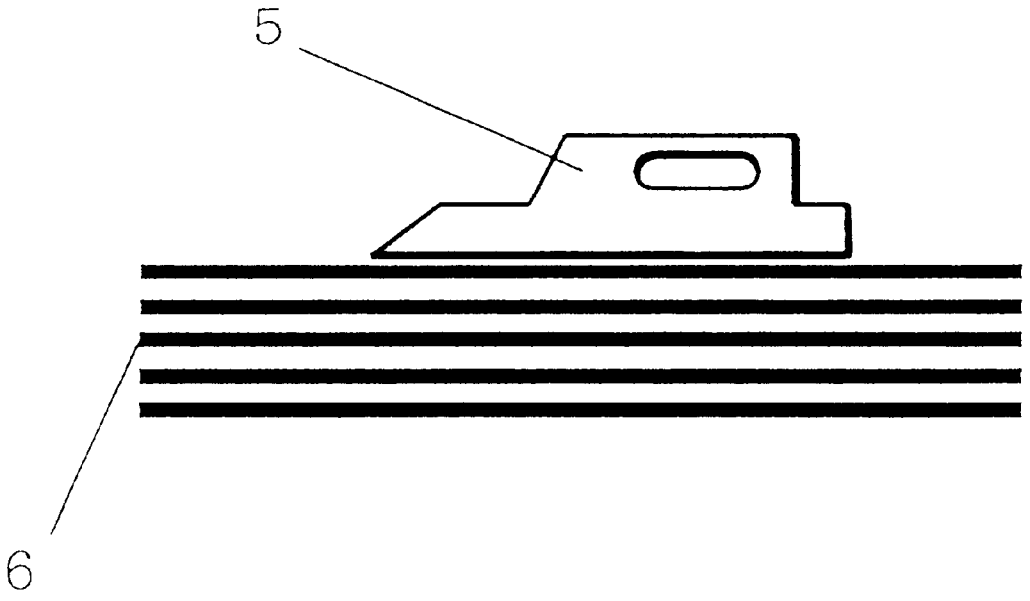
FIG. 2 is an illustrative view to explain the constitution of the testing device for testing the condition of generation of static electricity of the same.

With a device as shown in FIG. 2, an experiment was made to examine the condition of generation of static electricity. In FIG. 2, the numeral 5 shows an iron for test, and 6 is a silk test cloth of 10 cm×10 cm size. In said experiment, about 10 pieces of silk test cloths 6 were placed in layers, on which the test iron 5 was reciprocated for 10 times, and the generated static electricity was measured by a static electricity meter (Model No. 224CL), with simultaneous confirmation of the number of the silk test cloths 6 which adhered to the test iron 5.

Abrasion Resistance Test

With the temperature at the central part of the iron base surface adjusted to 220°+5° C., a weight of 3 kgf was added, after which, while charging a rated voltage (100 V) on the iron, the iron was subjected to sliding for 73 kms (corresponding to 5 years) on a cotton cloth. Thereafter, the abrasion amount was measured with a film thickness gauge (LZ-200 made by Kabushiki Kaisha Ketto Kagaku Kenkyusho) and a fluorescent light X-ray analyzer (SEA5120 made by SEIKO Denshi Kogyo Kabushiki Kaisha) and evaluated.

Example 1

Preparation of polytetrafluoroethylene (hereinafter to be abbreviated as PTFE) plating liquid Five parts by weight of PTFE fine particles (particle size no more than 2 $\mu$m; made by Daikin Kogyo Kabushiki Kaisha) were added to the nickel electrolyte bath having the following composition. A surfactant [trade mark, "MEGAFACK F150", made by Dainippon Ink Kagaku Kabushiki Kaisha, tertiary perfluoroammonium salt ($C_8F_{17}SO_2NH(CH_2)_3N+(CH_3)_3.Cl—$)] was added at the rate of 30.0 mg to 1 g of PTFE.

Nickel sulfamate electrolytic bath composition:

| | |
|---|---|
| Nickel sulfamate | 350 g/L |
| Nickel chloride | 45 g/L |
| Boric acid | 40 g/L |

*Plating method:

Firstly, with a cathode of aluminum alloy iron bottom base member (surface roughness 0.5 $\mu$m), using the wood bath having the following composition, under the conditions of the liquid temperature 25° C. and current density 10A/$dm^2$, a substrate nickel plating to the film thickness of 1 to 3 $\mu$m was carried out.

| Wood bath composition: | |
|---|---|
| Nickel chloride | 245 g/L |
| Hydrochloric acid | 120 g/L |

Next, under the conditions of the liquid temperature at 45°+5° C., pH 3.8–4.2, and current density 2A/dm$^2$, the above iron bottom base member was subjected to electrolytic plating while screw stirring until the film thickness came to 10 μm to form a nickel-PTFE composite plating film.

The resulting iron bottom base member having a nickel-PTFE composite plating film was heated in a hot air circulating type drying oven at 350° C. for 30 minutes, and then allowed to stand in a room for 1 hour until it came to room temperature. The PTFE content of the resulting iron bottom base member having nickel-PTFE composite plating film was 20%, and the contact angle of water was measured to be 120 degrees.

By changing the addition amount of PTFE to be added to the nickel bath, the iron bottom members with the PTFE contents of 5, 10, 15, 20, and 25% by volume (using the members having the surface roughness of 0.5 μm) were prepared, and using the irons provided with these iron bottom base members, non-adhesive tests were carried out. The results are shown in Table 1.

TABLE 1

| PTFE content (%) | 5 | 10 | 15 | 20 | 25 |
|---|---|---|---|---|---|
| Non-tackiness | x | Δ | ○ | ○ | ○ |

Evaluation standard on non-tackiness:

○: Good

Δ: Ordinary

X: Bad

Through the above experiments it was revealed that, when the content of polytetrafluoroethylene is more than 15% by volume, non-adhesive property effective to prevent the starch on the clothes from sticking in ironing could be assured. Further, it was found that, in case of the content being no more than 10% by volume, the non-adhesive property would be lowered.

Further, there were made the iron bottom base members having the composite plating films with the PTFE content of 15% and the surface roughness of 0.1, 0.3, 0.5, 1.0 and 1.5 μm, respectively, and, using the irons provided with these iron bottom base members, sliding property tests were carried out. The results are shown in Table 2.

TABLE 2

| Surface roughness Ra (μm) | 1.5 | 1.0 | 0.5 | 0.3 | 0.1 |
|---|---|---|---|---|---|
| Tensile load (g) | 200 | 150 | 30 | 25 | 30 |
| Slidability | Δ | ○ | ⊙ | ⊙ | ⊙ |

Evaluation standard:

⊙: Very good

○: Good

Δ: Ordinary

Through those experiments it was found that, when the finishing degree of the composite plating film of the bottom base member 1 was no more than 1.0 μm on measuring by the center line surface roughness, the sliding property could be improved, and preferably when the surface roughness of the composite plating film was no more than 0.5 μm, the better sliding property could be obtained.

Further, a static electricity test was carried out by using an iron with the surface roughness of the iron bottom base member of 0.5 μm and the PTFE content of 15% by volume.

As a result of the above, the iron furnished with the iron bottom base member treated with the fluororesin of Comparative Example had generation of 9 kV static electricity and adhesion of 3 sheets of silk test pieces of cloth 6. With the iron of this example, the number of the adhered silk test pieces 6 under the static electricity of no more than the minimum scale (no more than 1 kV) was zero. As reviewed above, according to this embodiment, it is possible to realize an iron which shows scarce generation of static electricity during the ironing work, due to the presence of transition metal 3.

Further, an abrasion resistance test was carried out by using an iron with the surface roughness of the iron bottom base member of 0.5 μm and the PTFE content of 15% by volume.

As a result of the above, the iron furnished with the iron bottom base member treated with the fluororesin of Comparative Example had abrasion amount of 3–10 μm. The iron of this embodiment showed the abrasion amount of 0.5–0.7 μm. As above, according to this embodiment it is possible to realize an iron which shows scarce abrasion of the surface coating during the ironing work, due to the presence of transition metal 3.

Example 2

PTFE - Non-electrolysis

In the same manner as in Example 1, a substrate nickel plated film was formed on the iron bottom base member (surface roughness 0.5 μm), after which, using a plating bath comprising the following materials as the main components and adding 1 part by weight of PTFE fine particles (particle size of no more than 2 μm, made by Daikin Kogyo Kabushiki Kaisha) and further a surfactant (trade mark "MEGAFACK F150", made by Dainippon Ink Kagaku Kabushiki Kaisha) at the rate of 30.0 mg based on 1 g of PTFE, a non-electrolytic nickel-PTFE composite plating film (10 μm) was formed.

Nickel non-electrolytic plating bath composition:

| | |
|---|---|
| Nickel sulfate hexahydride | 20 g/L |
| Sodium citrate | 8 g/L |
| Sodium malonate | 20 g/L |
| Sodium hypophosphite | 20 g/L |

An iron bottom base member provided with substrate nickel plating treatment was soaked in the above nickel non-electrolytic plating bath, and under the conditions of the liquid temperature of 90°±2° C., pH of 4.9–5.2, it was subjected to non-electrolytic plating while screw stirring for 1 hour until the film thickness became 10 μm to form a nickel-PTFE composite non-electrolytic plating film.

The resulting iron bottom base member having a nickel-PTFE composite plating film was heated in a hot air circulating type drying oven at 350° C. for 30 minutes, and then allowed to stand in a room for 1 hour until it came to room temperature. The PTFE content of the resulting iron bottom base member having nickel-PTFE composite plating film was 20%, and the contact angle of water was measured to be 120 degrees.

In the same manner as in Example 1, non-tackiness test, sliding property test, static electricity generation test, and abrasion resistance test were carried out. As a result, as shown in Table 3, the results were the same as in Example 1 with 0.5 μm of surface roughness and 20% of PTFE content, all being good.

TABLE 3

| Surface treatment | Test item | | | |
|---|---|---|---|---|
| | Non-tackiness | Slid-ability | Static Electricity | Abrasion resistance |
| Comparative Example; Fluororesin type coating composition coated iron | ⊙ | 150 (g) | 9 (kV) | 3–10 (μm) |
| This Example; Composite plating coated iron | ○ | 50 (g) | −1 (kV) | 0.5–0.7 (μm) |

Evaluation standard on non-tackiness:

⊙: Very good

○: Good

Δ: Ordinary

X: Bad

Abrasion resistance: Wear amount after sliding test

Example 3

Tetrafluoroethylene-hexafluoropropylene copolymer (hereinafter to be abbreviated as FEP):

In the same manner as in Example 1 except using a composite plating bath made by using 5 parts by weight of FEP fine particles (particle size no more than 2 μm, made by Daikin Kogyo Kabushiki Kaisha) and adding a surfactant (trade mark "MEGAFACK F150", made by Dainippon Ink Kagaku Kabushiki Kaisha) at a rate of 65.0 mg based on 1 g of FEP, the operation was made in the same manner as in Example 1 to form a substrate plating layer on the iron bottom base member (surface roughness 0.5 μm), followed by forming a nickel-FEP composite plating film (10 μm).

The resulting iron bottom base member having a nickel-FEP composite plating film was heated in a hot air circulating type drying oven at 250° C. for 30 minutes, and then allowed to stand in a room for 1 hour until it came to room temperature. The FEP content of the resulting iron bottom base member having nickel-FEP composite plating film was 20%, and the contact angle of water was measured to be 115 degrees.

In the same manner as in Example 1, non-tackiness test, sliding property test, static electricity generation test, and abrasion resistance test were carried out. As a result, as shown in Table 4, the results were all good.

TABLE 4

| Surface treatment | Test item | | | |
|---|---|---|---|---|
| | Non-tackiness | Slid-ability | Static Electricity | Abrasion resistance |
| Comparative Example; Fluororesin type coating composition coated iron | ⊙ | 150 (g) | 9 (kV) | 3–10 (μm) |
| This Example; Composite plating coated iron | ○ | 50 (g) | −1 (kV) | 0.7–0.9 (μm) |

Evaluation standard on non-tackiness:

⊙: Very good

○: Good

Δ: Ordinary

X: Bad

Abrasion resistance: Wear amount after sliding test

Example 4

Tetrafluoroethylene-perfluoroalkyl vinyl ether copolymer (hereinafter to be abbreviated as PFA):

In the same manner as in Example 1 except using a composite plating bath made by using 5 parts by weight of PFA fine particles (particle size no more than 2 μm, made by Daikin Kogyo Kabushiki Kaisha), and adding a surfactant (trade mark "MEGAFACK F150", made by Dainippon Ink Kagaku Kabushiki Kaisha) at a rate of 30.0 mg based on 1 g of PFA, the operation was made in the same manner as in Example 1 to form a substrate plating layer on the iron bottom base member (surface roughness 0.5 μm), followed by forming a nickel-PFA composite plating film (10 μm).

The resulting iron bottom base member having a nickel-FEP composite plating film was heated in a hot air circulating type drying oven at 340° C. for 30 minutes, and then allowed to stand in a room for 1 hour until it came to room temperature. The PFA content of the resulting iron bottom base member having nickel-PFA composite plating film was 20%, and the contact angle of water was measured to be 120 degrees.

In the same manner as in Example 1, non-tackiness test, sliding property test, static electricity generation test, and abrasion resistance test were carried out. As a result, as shown in Table 5, the results were all good.

TABLE 5

| Surface treatment | Test item | | | |
|---|---|---|---|---|
| | Non-tackiness | Slid-ability | Static Electricity | Abrasion resistance |
| Comparative Example; Fluororesin type coating composition coated iron | ⊙ | 150 (g) | 9 (kV) | 3–10 (μm) |
| This Example; Composite plating coated iron | ○ | 50 (g) | −1 (kV) | 0.6–0.8 (μm) |

Evaluation standard on non-tackiness:

⊙: Very good

○: Good

Δ: Ordinary

X: Bad

Abrasion resistance: Wear amount after sliding test

Example 5

Graphite Fluoride

In the same manner as in Example 1 except using a composite plating bath made by using 5 parts by weight of graphite fluoride fine particles (particle size no more than 1 μm, made by Asahi Glass Kabushiki Kaisha) and adding a surfactant (trade mark "MEGAFACK F150", made by Dainippon Ink Kagaku Kabushiki Kaisha) at a rate of 40.0 mg based on 1 g of graphite fluoride fine particles, the operation was made in the same manner as in Example 1 to form a substrate plating layer on the iron bottom base member (surface roughness 0.5 μm), followed by forming a nickel-graphite fluoride composite plating film (10 μm).

The resulting iron bottom base member having a nickel-graphite fluoride composite plating film was heated in a hot air circulating type drying oven at 350° C. for 30 minutes, and then allowed to stand in a room for 1 hour until it came to room temperature. The graphite fluoride content of the resulting iron bottom base member having nickel-graphite fluoride composite plating film was 20%, and the contact angle of water was measured to be 110 degrees.

In the same manner as in Example 1, non-tackiness test, sliding property test, static electricity generation test, and abrasion resistance test were carried out. The results were all good.

Example 6

Pitch Fluoride

In the same manner as in Example 1 except using a plating bath comprising 5 parts by weight of the pitch fluoride fine particles (average particle size 1.3 μm) obtained in Reference Example 1 and adding a surfactant (trade mark "MEGAFACK F150", made by Dainippon Ink Kagaku Kabushiki Kaisha) at a rate of 30.0 mg based on 1 g of pitch fluoride, the operation was made in the same manner as in Example 1 to form a substrate plating layer on the iron bottom base member (surface roughness 0.5 μm), followed by forming a nickel-pitch fluoride composite plating film (10 μm).

The resulting iron bottom base member having a nickel-pitch fluoride composite plating film was heated in a hot air circulating type drying oven at 250° C. for 30 minutes, and then allowed to stand in a room for 1 hour until it came to room temperature. The pitch fluoride content of the resulting iron bottom base member having nickel-pitch fluoride composite plating film was 20%, and the contact angle of water was measured to be 145 degrees.

In the same manner as in Example 1, non-tackiness test, sliding property test, static electricity generation test, and abrasion resistance test were carried out. The results were all good as in Table 6.

TABLE 6

| Surface treatment | Test item | | | |
|---|---|---|---|---|
| | Non-tackiness | Slid-ability | Static Electricity | Abrasion resistance |
| Comparative Example; Fluororesin type coating composition coated iron | ⊙ | 150 (g) | 9 (kV) | 3–10 (μm) |
| This Example; Composite plating coated iron | ○ | 70 (g) | −1 (kV) | 0.6–0.8 (μm) |

○: Good
Δ: Ordinary
X: Bad

Abrasion resistance: Wear amount after sliding test

Example 7

Pitch Fluoride—Non-Electrolysis

In the same manner as in Example 2 except using a plating bath comprising 1 part by weight of the pitch fluoride fine particles (average particle size 1.3 μm) obtained in Reference Example 1 and adding a surfactant (trade mark "MEGAFACK F150", made by Dainippon Ink Kagaku Kabushiki Kaisha) at a rate of 30.0 mg based on 1 g of pitch fluoride, the operation was made in the same manner as in Example 2 to form a substrate plating layer on the iron bottom base member (surface roughness 0.5 μm), followed by forming a nickel-pitch fluoride composite plating film (10 μm).

The resulting iron bottom base member having a nickel-pitch fluoride composite plating film was heated in a hot air circulating type drying oven at 250° C. for 30 minutes, and then allowed to stand in a room for 1 hour until it came to room temperature. The pitch fluoride content of the resulting iron bottom base member having nickel-pitch fluoride composite plating film was 20%, and the contact angle of water was measured to be 145 degrees.

In the same manner as in Example 1, non-tackiness test, sliding property test, static electricity generation test, and abrasion resistance test were carried out. The results were all good as in Table 7.

TABLE 7

| Surface treatment | Test item | | | |
|---|---|---|---|---|
| | Non-tackiness | Slid-ability | Static Electricity | Abrasion resistance |
| Comparative Example; Fluororesin type coating composition coated iron | ⊙ | 150 (g) | 9 (kV) | 3–10 (μm) |
| This Example; Composite plating coated iron | ○ | 60 (g) | −1 (kV) | 0.6–0.8 (μm) |

Evaluation standard on non-tackiness:

⊙: Very good
○: Good
Δ: Ordinary
X: Bad

Abrasion resistance: Wear amount after sliding test

Example 8

PTFE-FEP

In the same manner as in Example 1 except using a composite plating bath made by using 2.5 parts by weight of the PTFE fine particles (average particle size no more than 2 μm, made by Daikin Kogyo Kabushiki Kaisha) and 2.5 parts by weight of the FEP fine particles (average particle size no more than 2 μm, made by Daikin Kogyo Kabushiki Kaisha) and adding a surfactant (trade mark "MEGAFACK F150", made by Dainippon Ink Kagaku Kabushiki Kaisha) at a rate of 30.0 mg based on 1 g of PTFE and 65.0 mg based on 1 g of FEP, the operation was made in the same manner as in Example 1 to form a substrate plating layer on the iron bottom base member (surface roughness 0.5 μm), followed by forming a nickel-PTFE-FEP composite plating film (10 μm).

The resulting iron bottom base member having a nickel-PTFE-FEP composite plating film was heated in a hot air circulating type drying oven at 250° C. for 30 minutes, and then allowed to stand in a room for 1 hour until it came to room temperature. The total content of PTFE and FEP in the resulting iron bottom base member having nickel-PTFE-FEP composite plating film was 20%, and the contact angle of water was measured to be 120 degrees.

In the same manner as in Example 1, non-tackiness test, sliding property test, static electricity generation test, and abrasion resistance test were carried out. The results were all good as in Table 8.

TABLE 8

| Surface treatment | Test item | | | |
|---|---|---|---|---|
| | Non-tackiness | Slid-ability | Static Electricity | Abrasion resistance |
| Comparative Example; Fluororesin type coating composition coated iron | ◎ | 150 (g) | 9 (kV) | 3–10 (μm) |
| This Example; Composite plating coated iron | ○ | 55 (g) | −1 (kV) | 0.6–0.8 (μm) |

Evaluation standard on non-tackiness:

◎: Very good

○: Good

Δ: Ordinary

X: Bad

Abrasion resistance: Wear amount after sliding test

Example 9

Pitch Fluoride-FEP

In the same manner as in Example 1 except using a composite plating bath made by using 1.25 parts by weight of the pitch fluoride fine particles (average particle size 1.3 μm) and 5 parts by weight of FEP fine particles (particle size no more than 2 μm, made by Daikin Kogyo Kabushiki Kaisha) and adding a surfactant (trade mark "MEGAFACK F150", made by Dainippon Ink Kagaku Kabushiki Kaisha) at a rate of 30.0 mg based on 1 g of pitch fluoride and 65.0 mg based on 1 g of FEP, the operation was made in the same manner as in Example 1 to form a substrate plating layer on the iron bottom base member (surface roughness 0.5 μm), followed by forming a nickel-pitch fluoride-FEP composite plating film (10 μm).

The resulting iron bottom base member having a nickel-pitch fluoride-FEP composite plating film was heated in a hot air circulating type drying oven at 250° C. for 30 minutes, and then allowed to stand in a room for 1 hour until it came to room temperature. The total content of the pitch fluoride and FEP in the resulting iron bottom base member having nickel-pitch fluoride composite plating film was 20%, and the contact angle of water was measured to be 130 degrees.

In the same manner as in Example 1, non-tackiness test, sliding property test, static electricity generation test, and abrasion resistance test were carried out. The results were all good as in Table 9.

TABLE 9

| Surface treatment | Test item | | | |
|---|---|---|---|---|
| | Non-tackiness | Slid-ability | Static Electricity | Abrasion resistance |
| Comparative Example; Fluororesin type coating composition coated iron | ◎ | 150 (g) | 9 (kV) | 3–10 (μm) |
| This Example; Composite plating coated iron | ○ | 70 (g) | −1 (kV) | 0.6–0.8 (μm) |

Evaluation standard on non-tackiness:

◎: Very good

○: Good

Δ: Ordinary

X: Bad

Abrasion resistance: Wear amount after sliding test

Example 10

PTFE-FEP-Pitch Fluoride

In the same manner as in Example 1 except using a composite plating bath made by using 1.25 parts by weight of the pitch fluoride fine particles (average particle size 1.3 μm), 2.5 parts by weight of PTFE fine particles (particle size no more than 2 μm, made by Daikin Kogyo Kabushiki Kaisha) and 2.5 parts by weight of FEP fine particles (particle size no more than 2 μm, made by Daikin Kogyo Kabushiki Kaisha) and adding a surfactant (trade mark "MEGAFACK F150", made by Dainippon Ink Kagaku Kabushiki Kaisha) at a rate of 30.0 mg based on 1 g of pitch fluoride, 30.0 mg based on 1 g of PTFE and 65.0 mg based on 1 g of FEP, the operation was made in the same manner as in Example 1 to form a substrate plating layer on the iron bottom base member (surface roughness 0.5 μm), followed by forming a nickel-pitch fluoride-PTFE-FEP composite plating film (10 μm).

The resulting iron bottom base member having a nickel-pitch fluoride-PTFE-FEP composite plating film was heated in a hot air circulating type drying oven at 250° C. for 30 minutes, and then allowed to stand in a room for 1 hour until it came to room temperature. The total content of the pitch fluoride and FEP in the resulting iron bottom base member having nickel-pitch fluoride composite plating film was 20%, and the contact angle of water was measured to be 125 degrees.

In the same manner as in Example 1, non-tackiness test, sliding property test, static electricity generation test, and abrasion resistance test were carried out. The results were all good as in Table 10.

TABLE 10

| Surface treatment | Test item | | | |
|---|---|---|---|---|
| | Non-tackiness | Slid-ability | Static Electricity | Abrasion resistance |
| Comparative Example; Fluororesin type coating composition coated iron | ◎ | 150 (g) | 9 (kV) | 3–10 (μm) |
| This Example; Composite plating coated iron | ○ | 60 (g) | −1 (kV) | 0.6–0.8 (μm) |

Evaluation standard on non-tackiness:

◎: Very good

○: Good

Δ: Ordinary

X: Bad

Abrasion resistance: Wear amount after sliding test

Example 11

Colored Pitch Fluoride

To 30 g of the pitch fluoride fine particles (average particle size 1.3 μm) obtained in Reference Example 1, 0.3 g of blue inorganic dyestuff (Methylene blue FZ, made by Daiwa Kako Kabushiki Kaisha) was added, and the mixture was colored by reaction in methanol of 3-fold amount at 60° C. to give 29.8 g of colored pitch fluoride.

Except using the said colored pitch fluoride, the operation was made in the same manner as in Example 6 to form a substrate plating layer on the iron bottom base member (surface roughness 0.5 μm), followed by forming a nickel-colored pitch fluoride composite plating film (10 μm).

The resulting iron bottom base member having a nickel-colored pitch fluoride composite plating film was heated in a hot air circulating type drying oven at 250° C. for 30 minutes, and then allowed to stand in a room for 1 hour until it came to room temperature. The pitch fluoride content of the resulting iron bottom base member having blue colored nickel-pitch fluoride composite plating film was 20%, and the contact angle of water was measured to be 145 degrees.

In the same manner as in Example 1, non-tackiness test, sliding property test, static electricity generation test, and abrasion resistance test were carried out. The results were all good as in Table 11.

TABLE 11

| Surface treatment | Test item | | | |
|---|---|---|---|---|
| | Non-tackiness | Slid-ability | Static Electricity | Abrasion resistance |
| Comparative Example; Fluororesin type coating composition coated iron | ◎ | 150 (g) | 9 (kV) | 3–10 (μm) |
| Example 11; Blue composite plating coated iron | ○ | 70 (g) | −1 (kV) | 0.6–0.8 (μm) |
| Example 12; Yellow composite plating coated iron | ○ | 70 (g) | −1 (kV) | 0.6–0.8 (μm) |
| Example 13; Green composite plating coated iron | ○ | 70 (g) | −1 (kV) | 0.6–0.8 (μm) |

Evaluation standard on non-tackiness:

◎: Very good

○: Good

Δ: Ordinary

X: Bad

Abrasion resistance: Wear amount after sliding test

Example 12

Except that the yellow inorganic dyestuff (Chrysolidine made by Daiwa Kako Kabushiki Kaisha) was used, the plating treatment was carried out in the same manner as in Example 11. The pitch fluoride content of the resulting iron bottom base member having the yellow nickel-pitch fluoride composite plating film was 20%, and the contact angle of water was measured to be 145 degrees.

In the same manner as in Example 1, non-tackiness test, sliding property test, static electricity generation test, and abrasion resistance test were carried out. The results were all good as in Table 11.

Example 13

Except that the green inorganic dyestuff (Master Fine Color MF5320 made by Dainippon Seika Kabushiki Kaisha) was used, the plating treatment was carried out in the same manner as in Example 11. The pitch fluoride content of the resulting iron bottom base member having the green nickel-pitch fluoride composite plating film was 20%, and the contact angle of water was measured to be 145 degrees.

In the same manner as in Example 1, non-tackiness test, sliding property test, static electricity generation test, and abrasion resistance test were carried out. The results were all good as in Table 11.

Comparative Example

An aluminum alloy-made iron bottom base member (surface roughness 0.5 μm) was coated with a fluororesin type coating composition to form a fluororesin coating film. The contact angle of water of the coating film was measured to be 110 degrees.

In the same manner as in Example 1, non-tackiness test, sliding property test, static electricity generation test, and abrasion resistance test were carried out. As shown in Table 12, the results were all inferior to those of the nickel-PTFE composite plating film or nickel-pitch fluoride composite plating film.

TABLE 12

| Surface treatment | Test item | | | |
|---|---|---|---|---|
| | Non-tackiness | Slid-ability | Static Electricity | Abrasion resistance |
| Comparative Example; Fluororesin type coating composition coated iron | ◎ | 150 (g) | 9 (kV) | 3–10 (μm) |
| Nickel-PTFE composite plating coated iron | ○ | 50 (g) | −1 (kV) | 0.5–0.7 (μm) |
| Nickel-pitch fluoride composite plating coated iron | ○ | 70 (g) | −1 (kV) | 0.6–0.8 (μm) |

Evaluation standard on non-tackiness:

◎: Very good

○: Good

Δ: Ordinary

X: Bad

Abrasion resistance: Wear amount after sliding test

Example 14

Figure 3:
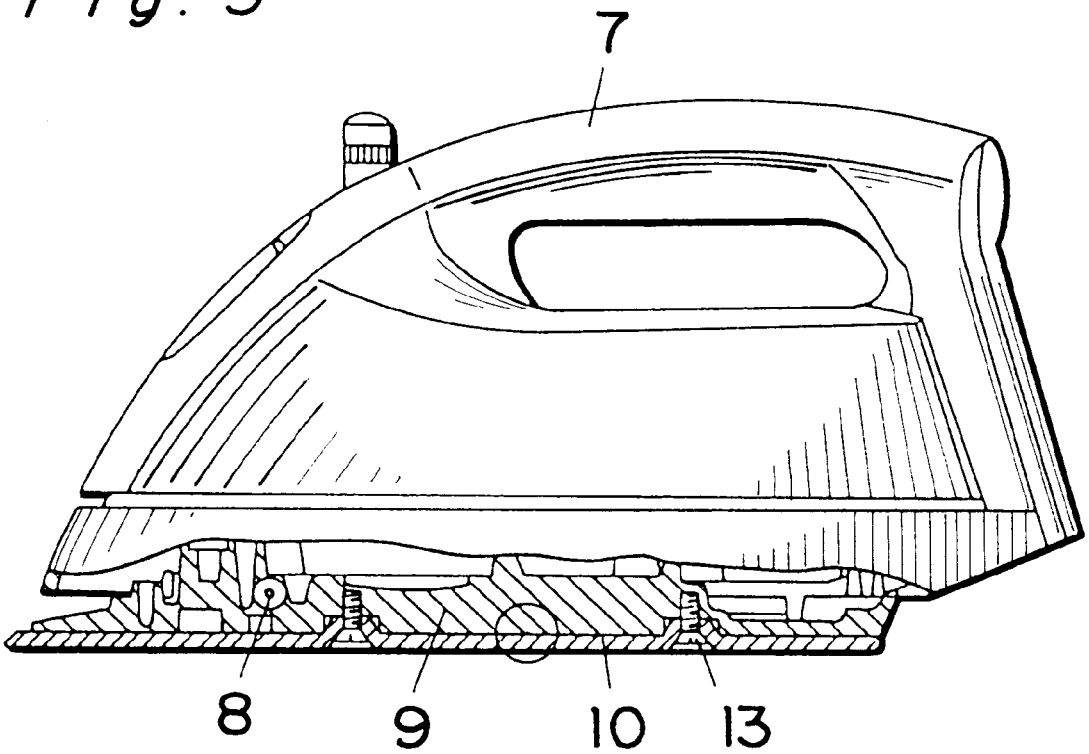
FIG. 3 is a side view showing in section an essential part of the iron in Example 13 of the present invention.
Figure 4:
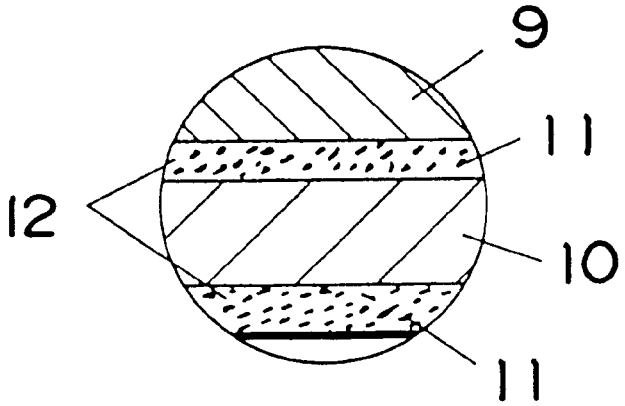
FIG. 4 is an enlarged sectional view of an essential part of the iron of the same.

As shown in FIG. 3 and FIG. 4, the iron 7 has a base member 9 which is to be heated with a heater 8 buried in molding by die cast processing or the like. On the lower surface side of the base member 9, an ironing face member (corresponding to the iron bottom base member) 10, on which there is formed a composite plating film 12 containing the fluorine compound fine particles 11 in dispersed state, is combined with screws 13.

Formation of a composite plating film 12 on the ironing face member 10 is carried out by a general method of dipping the ironing face member 10 in the liquid bath for composite plating. The composite plating film 12 is formed all over the surface of the ironing face member 10. Accordingly, when the ironing face member 10 is fixed to the base member 9, the composite plating film 12 is formed even on the portion not exposed outside.

As above, by such construction that the ironing face member 10 on which the composite plating film 12 is formed on the surface is combined with the base member 9, the plating film does not adhere to the terminal part of the heater 8 which is buried in the base member 9, and a danger of occurrence of insulation deterioration of the heater 8 can be eliminated in the process of providing combined plating film. Further, without providing any special processing to prevent adhesion of plating film, the manufacture can be easily carried out.

Example 15

Figure 5:
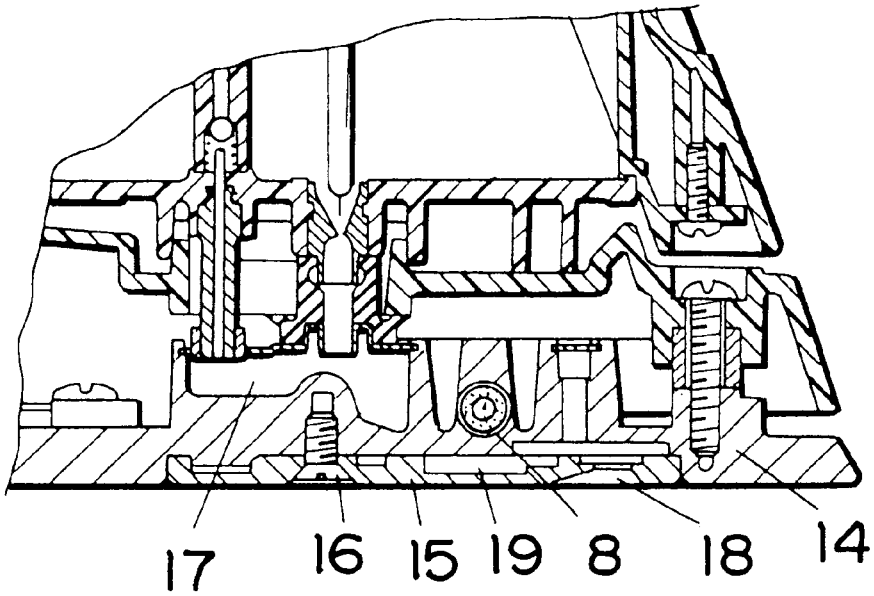
FIG. 5 is a sectional view of an essential part of the iron in Example 14 of the present invention.

As shown in FIG. 5, a heater 8 is buried in the base member 14. On the lower surface side of the base member 14, an ironing face member 15 is fitted with screws 16, and on the upper surface side thereof, an evaporation chamber 17 for evaporating water is formed. On the surface of the ironing face member 15, there is formed a composite plating film containing the fluorine compound fine particles in dispersed state. The remaining construction is same as in Example 14.

To explain the operation in the above constitution, because the evaporation chamber 17 is formed on the base member 14 and a composite plating film containing the fluorine compound fine particles in dispersed state is provided only on the surface of the ironing face member 15, it does not occur for a composite plating film having remarkable water repellency to be formed on the surface of the evaporation chamber 17. Accordingly, there can be obtained an iron which can evaporate the water dropping into the evaporation chamber 17 in good efficiency, and which does not interfere with generation of steam.

Further, because of the formation of a composite plating film containing the fluorine compound fine particles in dispersed state on the surface of the ironing face member 15, the hardness of the ironing face can be made very high, so that the surface of the ironing face can be prevented from causing scratches.

Also, it is possible to improve the abrasion resistance, to provide less tendency of abrasion even over a long period of ironing, and the composite plating film can improve the sliding property with the cloth when the temperature of the ironing face is high, thereby permitting easy ironing work.

Example 16

Figure 6:
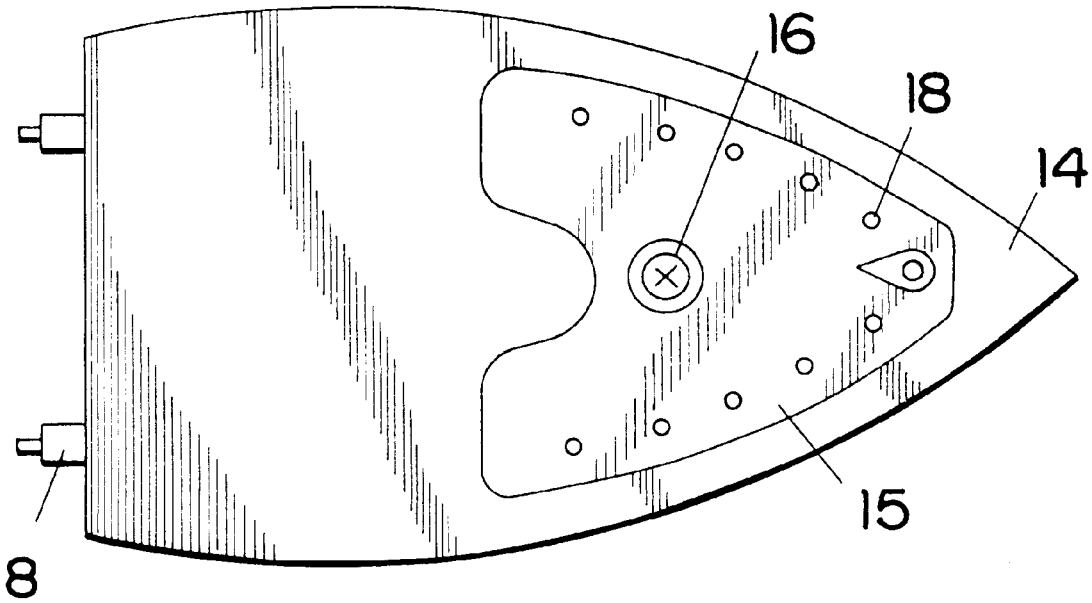
FIG. 6 is a bottom face view of the iron in Example 15 of the present invention.
Figure 7:
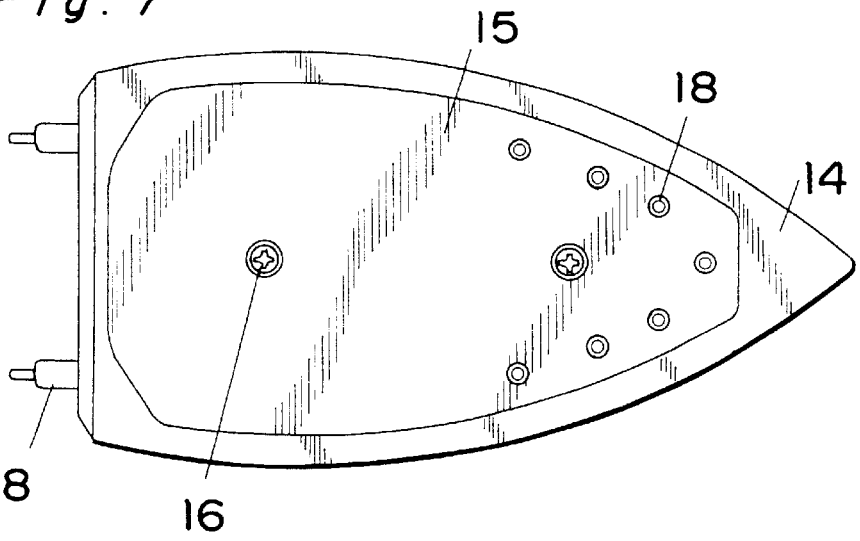
FIG. 7 is a bottom face view of the iron of the same.

As shown in FIG. 5–FIG. 7, the base member 14 has a heater 8 in buried state. On the surface of at least the ironing face side a fluroresin layer is formed. And, on the ironing face of the base member 14, i.e., on a part of the bottom face side, an ironing face member 15 is combined with screws 16 in a manner to surround the circumference of the ironing face member 15 with the fluororesin layer provided on the base member 14.

On the surface of the ironing face member 15, there is formed a composite plating film containing the fluorine compound fine particles in dispersed state. The ironing face member 15 is provided with a plurality of steam holes 18. Between the base member 14 and the ironing face member 15, a pathway 19 is provided for leading the steam generated in the evaporation chamber 17 to the steam hole 18. The remaining construction is same as that of Example 14.

To explain the operation in the above construction since the ironing face member 15 having a composite plating film thereon is constituted on a part of the bottom face side of the base member 14 and has a simple configuration with less roughness, the surface area forming the composite plating film can be lessened to realize a low priced product.

Further, because there is provided between the base member 14 and the ironing face member 15 a pathway 19 for leading the steam generated in the evaporation chamber 17 to the steam holes 18, the evaporation residues or impurities such as deposits accumulated on the pathway 19 can be easily eliminated by detaching the ironing face member 15.

Furthermore, as a fluororesin layer is formed on the surface of the bottom face side of the base member 14 in a manner to surround the circumference of the ironing face member 15, sliding property of the iron with the cloth in ironing can be improved.

Example 17

Figure 8:
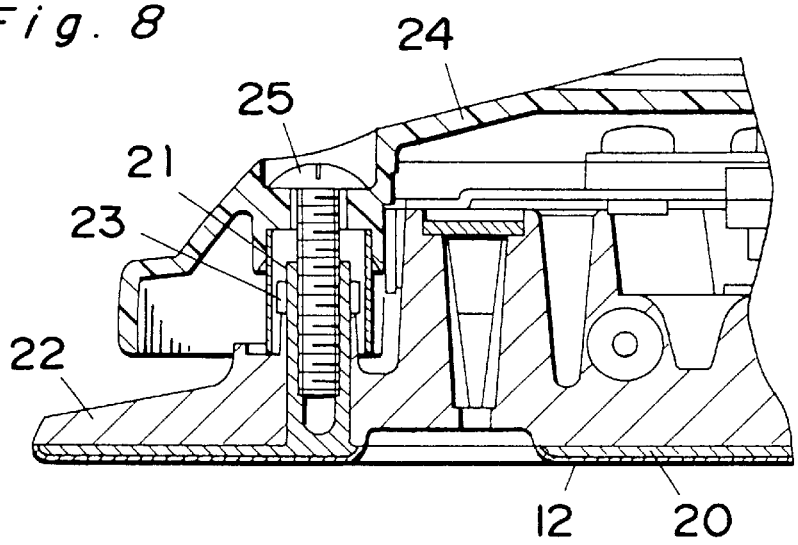
FIG. 8 is a sectional view of an essential part of the iron in Example 16 of the present invention.

As shown in FIG. 8, the ironing face member 20 is provided with a composite plating film 12 containing the fluorine compound fine particles in a dispersed state at least on the surface of the ironing face. A fastening member 21, projecting upward on the upper face side of the ironing face member 20, is passed through the hole of the base member 22, to combine the ironing face member 20 from the upper face side of the base member 20 with the nut 23. And, to the fastening member 21, a cover 24 covering the base member 22 from the upper face side is fixed with the screw 25. The remaining construction is same as that of the above Example 14.

To explain the operation in the above construction, it is possible to obtain an iron which does not form a composite plating film on the surface of the evaporation chamber (not illustrated) and not interfere with the steam generation. Also, the ironing face of the ironing face member 20 can be smoothly constituted, and prevention can be made of the cloth from being caught by the screws or the like.

Example 18

Figure 9:
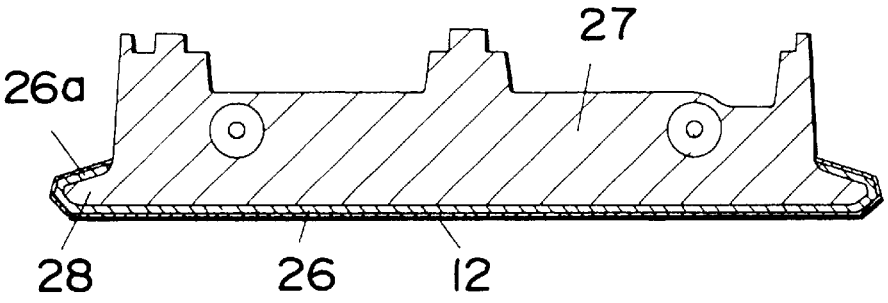
FIG. 9 is a sectional view of an essential part of the iron in Example 17 of the present invention.

As shown in FIG. 9, the ironing face member 26 is made by forming a composite plating film 12 containing the fluorine compound fine particles in dispersed state at least on the surface of the ironing face and rolling the outer peripheral part 26*a* thereof on the outer peripheral part 28 of the end face from the lower face side of the base member 27. The remaining construction is same as in Example 14.

To explain the operation of the above construction, there can be obtained an iron which does not form a composite plating film on the surface of the evaporation chamber (not illustrated) and not interfere with the steam generation. Also, the ironing face member 26 can be securely combined with the base member 27.

Example 19

Figure 10:
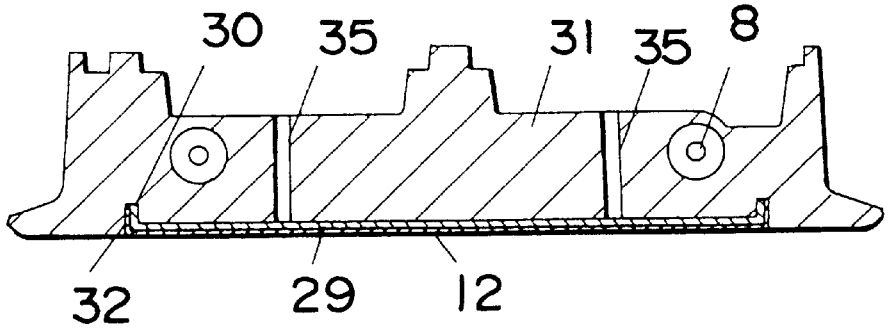
FIG. 10 is a sectional view of an essential part of the iron in Example 18 of the present invention.

As shown in FIG. 10, the ironing face member 29 is made by forming a composite plating film 12 containing the fluorine compound fine particles in dispersed state at least on the surface of the ironing face and a flange part 30 bent upward on the outer peripheral part thereof.

And, the base member 31 is provided with a recess 32 opposite to the flange part 30, so that the flange part 30 of the ironing face member 29 is inserted under pressure into the recess 32 provided on the base member 31 to combine. The remaining construction is same as in Example 15.

To explain the operation of the above construction, there can be obtained an iron which does not form a composite plating film on the surface of the evaporation chamber (not illustrated) and not interfere with the steam generation. Also, the process of combining the ironing face member 29 with the base member 31 can be simplified, and the ironing face member 29 can be securely combined with the base member 31.

Example 20

Figure 11:
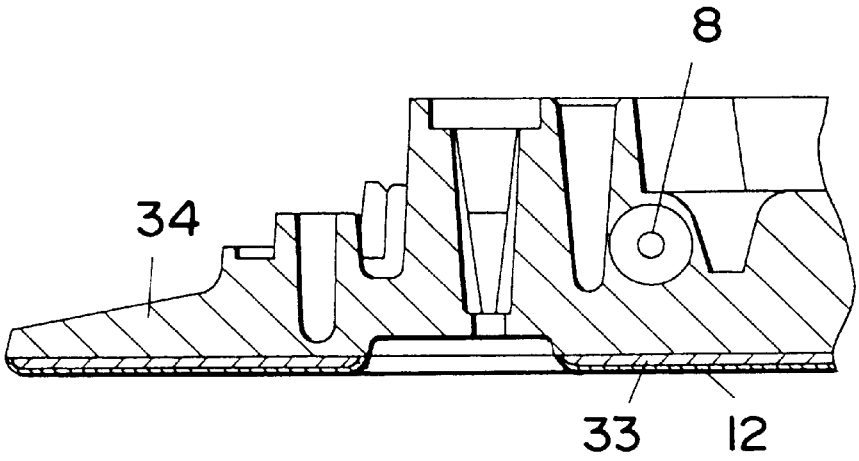
FIG. 11 is a sectional view of an essential part of the iron in Example 19 of the present invention.

As shown in FIG. 11, the ironing face member 33 is made by forming a composite plating film 12 containing the fluorine compound fine particles in dispersed state at least on the surface of the ironing face. The base member 34 in which the ironing face member 33 and the heater 8 are buried is formed integrally simultaneously with die cast molding of the base member 34. The remaining construction is the same as in Example 19.

To explain the operation in the above constitution, there can be obtained an iron which does not form a composite plating film on the surface of the evaporation chamber (not illustrated) and does not interfere with the steam generation. Also, the ironing face member 33 and the base member 34 can be combined in tight contact with each other, and the heat conductivity from the base member 34 to the ironing face member 33 can be improved, and further, the process in combining the ironing face member 33 with the base member 34 can be simplified, and the ironing face member 33 can be securely combined with the base member 34.

Example 21

As shown in FIG. 10, the base member 31 for combining the ironing face member 29 with the bottom face side is provided with a number of through-holes for communicating from the lower face side to the upper face side. The remaining construction is the same as in Example 19.

To explain the operation in the above construction, in combining the ironing face member 29 with the lower face side of the base member 31, it is possible to relieve the air between the two members through the pass-hole 35 to increase the tight contact property, and further, to transfer in good efficiency the heat from the base member 31 heated with the heater 8 to the ironing face member 29.

In this Example 21, the pass-hole 35 is formed on the base member 31, but it may be formed on the ironing member 29 side. Alternatively, the pass-hole 35 formed on the ironing face member 29 may be replaced by the steam hole 18 as explained in Example 15 above to give the similar effect.

Example 22

The ironing face member 10 in FIG. 3 is formed of a material having good heat conductivity such as copper, aluminum or alloy containing them. Other constitutions are same as those of Example 14.

According to the above constitution, the heat from the base member 9 heated with the heater 8 can be transmitted in good efficiency to the clothes through the ironing face member 10. Although the above explanation has been made on the ironing face member 10 in FIG. 3*a,* similar effect can be obtained with respect to the respective ironing face members in other examples by forming it with the good heat conductive materials.

Example 23

Figure 12:
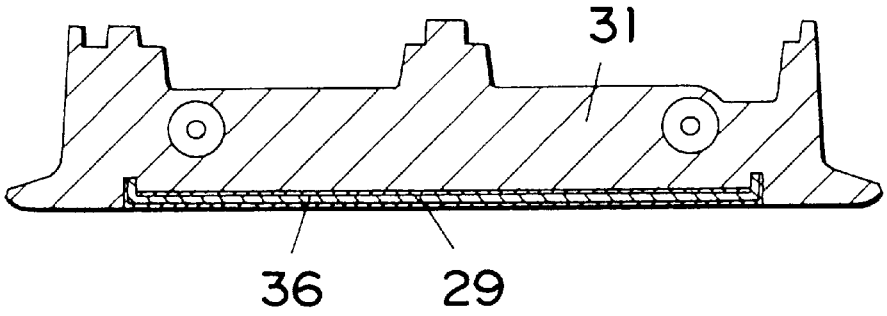
FIG. 12 is a sectional view of an essential part of the iron in Example 22 of the present invention.

As shown in FIG. 12, the good heat conductive member 36 is formed of copper, aluminum or alloy containing them, or a sheet-form member formed of a material having excellent heat conductivity such as graphite, or a paste form member containing the powder of the material having excellent heat conductivity such as copper, aluminum, or carbon, and is set between the base member 31 and the ironing face member 29. Other constitutions are same as the above Example 19.

According to the above construction, the heat from the base member 31 can be transmitted to the ironing face member 29 in good efficiency, by the good heat conductive member 36 and the surface temperature of the ironing face member 29 can be made even.

Example 24

The ironing face member 10 in FIG. 3 is formed of a metal material such as stainless steel or titanium, or of good corrosion resistant material of ceramics such as aluminum oxide, aluminum nitrate, or zirconia. The remaining construction is the same as in Example 14.

According to the above construction, it is possible to prevent the ironing face member 10 from corroding by steam or the like. Similar effect can be obtained with the ironing face members of other examples by forming with the good corrosion resistant materials.

Example 25

The ironing face member 10 in FIG. 3 has a composite plating film 12 containing the fluorine compound fine particles in dispersed state with smoothed surface. The remaining construction is the same as in the Example 14.

According to the above construction, by forming a compound plating film 12 containing the fluorine compound fine particles in dispersed state by smoothing the surface of the ironing face member 10, the composite plating film 12 can be smoothly formed. Accordingly, during the ironing work, the iron is easily slidable on the wet clothes. Thus, convenience of use can be improved.

Similar effect can be obtained with the ironing face members of other examples by forming a composite plating film 12 containing the fluorine compound fine particles in dispersed state by smoothing the surface.

Example 26

The ironing face member 15 in FIG. 7 has a composite plating film containing the fluorine compound fine particles in dispersed state with the surface roughened. The remaining construction is the same as Example 16.

According to the above construction, by forming the surface of the ironing face member 15 in rough surface, the surface area is enlarged, so that the tight contact property of the composite plating film is improved. In addition, even when a finger mark or the like is put on the composite plating film, soiling by finger marks or the like can be made less conspicuous. A similar effect can be obtained with the ironing face members of other examples by forming a composite plating film containing the fluorine compound fine particles in dispersed state by roughening the surface.

The ironing face member 10 in FIG. 3 is formed of an aluminum rolled plate, and on the surface of the aluminum rolled plate a composite plating film containing the fluorine compound fine particles is formed. The remaining construction is the same as in of Example 14.

According to the above construction, it is possible to form a rigid film which has no pinhole or the like on the ironing face member, and is free from the danger of the composite plating film from being released from the aluminum rolled plate by the air swelling on heating.

The first means of the present invention has a construction wherein the fluorine compound fine particles having an average particle size of no more than 2 $\mu$m are uniformly dispersed in nickel-chromium or a transition metal of combination of them, thereby realizing an iron having good slidability and high surface hardness to show less abrasion or scratch, and less generation of static electricity.

The second means of the present invention is characterized in specially adopting more than 15% by volume of the content of the fluorine compound fine particles, thereby realizing an iron with elevated non-tackiness property with which the starch of the clothes to be ironed can be prevented from adhering to the iron.

The third means of the present invention is characterized in that a composite plating film is provided on the surface of the iron base member, after which it is subjected to heat treatment at a temperature higher than the melting point of the fluorine compound fine particles (excluding graphite fluoride), thereby remarkably improving the durability and surface water repellency of the composite plating film.

The fourth means of the present invention is specially to make the surface roughness of the composite plating film no more than 1.0 $\mu$m, thereby realizing an iron with further improved slidability.

The fifth means of the present invention can solve the point of the conventional aluminum die cast material which is less easy to be plated and is apt to show loss of corrosion resistance due to the surface pores. This problem has been settled by using an aluminum rolled plate for the iron bottom base member.

According to the sixth means of the present invention, is in being furnished with a base member which is to be heated by the heater and an ironing face member by combining on the bottom surface side of the base member by forming a composite plating film containing the fluorine compound fine particles in dispersed state, by which it is possible to prevent formation of the composite plating film on the base member and to prevent undesirable effect on the heater which is provided on the base member, and further, to make it possible to carry out ironing by the ironing face member combined with the lower surface side of the base member. Moreover, the hardness of the ironing face is increased to prevent scratches, and the abrasion resistance is improved to give less wear on the long-period ironing.

According to the seventh means of the present invention, an evaporation chamber is formed on the base member, so that the composite plating film containing the fluorine compound fine particles in dispersed state on the surface of the evaporation chamber is not formed. Accordingly, the water which dropped into the evaporation chamber can be favorably evaporated, and stabilized steam jetting can be expected.

According to the eighth means of the present invention, because an ironing face member is provided on a part of the lower surface side of the base member, the surface area for forming the composite plating film can be reduced, and realization at a low price is possible.

According to the ninth means of the present invention, steam holes are provided on the ironing face member and a pathway for leading the steam generated in the evaporation chamber to the steam holes is formed between the base member and the ironing face member, so that it is possible to eliminate easily the evaporation residues and impurities such as water deposit accumulated on the pathway by removing the ironing face member.

According to the tenth means of the present invention, the ironing face member is set from the upper surface side of the base member, which serves to smooth the ironing face, and to prevent the clothing from being caught by screws.

According to the eleventh means of the present invention, a good heat conductive member has been arranged between the base member and the ironing face member, by which it is possible to transmit the heat from the base member to the ironing face member in good efficiency, and to make the surface temperature of the ironing face member evenly elevated.

According to the twelfth means of the present invention, the ironing face member is constituted by forming a composite plating film containing the fluorine compound fine particles on the surface of the aluminum rolled plate. Therefore, it is possible to form a rigid coating film which has no pinhole on the ironing face member and which has no danger of release of the composite plating film from the aluminum rolled plate by the air swollen by heating.

What is claimed is:

1. An iron comprising a bottom portion acting ironing face on which a plated metal film is provided, said plated metal film containing fluorine compound fine particles dispersed randomly in the thickness direction of the plated metal film.

2. The iron as claimed in claim 1, wherein the fluorine compound fine particles have a particle diameter smaller than the metal film thickness.

3. The iron as claimed in claim 1, wherein the content of the fluorine compound fine particles in the plated metal film is more than 15% by volume.

4. The iron as claimed in claim 1, wherein the fluorine compound particles are one or more than two selected from the group consisting of polytetrafluoroethylene (PTF), tetrafluoroethylene-hexafluoropropylene copolymer (FEP), tetrafluoroethylene-perfluoroalkyl vinyl ether copolymer (PFA), graphite fluoride, pitch fluoride, and colored pitch fluoride prepared by reacting pitch fluoride with a dye or a pigment.

5. The iron as claimed in claim 1, wherein the plated metal film containing the fluorine compound fine particles in a dispersed state is subjected to heat treatment at a temperature higher than the melting point of the fluorine compound (excluding graphite fluoride) fine particles.

6. The iron as claimed in claim 1, wherein the surface roughness of the plated metal film provided on the bottom portion is 1.0 $\mu$m or less.

7. The iron as claimed in claim 1, wherein the bottom portion is made of an aluminum rolled plate.

8. The iron according to claim 1, wherein said plated metal film comprises a transition metal matrix having fluorine compound fine particles dispersed therein.

9. The iron according to claim 1, wherein said plated metal film comprises a metal matrix selected from the group consisting of copper, nickel, chromium, zinc, cadmium, tin, iron, lead, precious metals and alloys thereof.

10. An iron comprising:

a base member having upper and lower surfaces, an ironing face member having upper and lower faces, said ironing face member positioned below said base member with said upper face confronting at least a portion of said lower surface of said base member, and a metal film plated on said lower face of said ironing face member, wherein said metal layer contains fluorine compound fine particles dispersed randomly throughout the metal film in the thickness direction.

11. The iron as claimed in claim 10, wherein an evaporation chamber is formed in said base member.

12. The iron as claimed in claim 11, wherein said ironing face member is provided with steam holes and a pathway for leading steam generated in the evaporation chamber to the steam holes is formed between the base member and ironing face member.

13. The iron as claimed in claim 10, wherein the ironing face member is attached to the base member by means provided at the upper face of said ironing base member.

14. The iron as claimed in claim 10, wherein a member having good heat conductivity is provided between the lower surface of said base member and the upper face of said ironing face member.

15. The iron as claimed in claim 10, wherein said ironing face member comprises a rolled aluminum plate and said plated metal film is formed on at least the lower face thereof.

16. A method of manufacturing an iron comprising a base member having upper and lower surfaces, an ironing face member having upper and lower faces with the upper face confronting the lower surface of said base member, and a metal film containing fluorine compound fine particles dispersed therein, plated on at least a portion of the lower face of said ironing face member, which method comprises plating said film on said ironing face member with a plating liquid containing the metal to be plated and fluorine compound fine particles dispersed in said liquid.

17. The method according to claim 16, wherein the plating is performed by electroplating.

18. The method according to claim 16, wherein said plating is non-electrolytic.

19. The method according to claim 18, wherein said plating liquid includes a surfactant for dispersion of the fluorine compound fine particles.

20. The method according to claim 16 wherein an evaporation chamber is formed in said base member.

* * * * *